US007438010B2

(12) United States Patent
Lyman

(10) Patent No.: US 7,438,010 B2
(45) Date of Patent: Oct. 21, 2008

(54) THREAD SPOOL AND CAP

(75) Inventor: James Lyman, North Logan, UT (US)

(73) Assignee: Hemingworth, Inc., Logan, UT (US)

( * ) Notice: Subject to any disclaimer, the term of this patent is extended or adjusted under 35 U.S.C. 154(b) by 0 days.

(21) Appl. No.: 11/380,891

(22) Filed: Apr. 28, 2006

(65) Prior Publication Data

US 2007/0084954 A1 Apr. 19, 2007

Related U.S. Application Data

(60) Provisional application No. 60/717,104, filed on Sep. 14, 2005.

(51) Int. Cl.
*D05B 51/00* (2006.01)
*D05B 91/16* (2006.01)

(52) U.S. Cl. ..... 112/302; 242/601

(58) Field of Classification Search ..... 112/302, 112/258, 278; 242/137.1, 129, 129.8, 593, 242/171, 601, 614, 615, 118; 206/388, 398, 206/407, 409, 415, 389, 391; 223/106
See application file for complete search history.

(56) References Cited

U.S. PATENT DOCUMENTS 349,440 A * 9/1886 Looker ..... 242/137.1
1,283,024 A * 10/1918 Armstrong ..... 242/137.1
1,443,533 A 1/1923 Hall et al.
1,593,775 A * 7/1926 Privracky ..... 223/106
1,675,193 A 6/1928 Omsk
2,044,207 A 6/1936 Chaffin
2,222,921 A 11/1940 van den Bergh
2,340,184 A 1/1944 Gray
2,630,981 A * 3/1953 Strocco ..... 225/38

(Continued)

FOREIGN PATENT DOCUMENTS

JP 404084990 A * 3/1992

(Continued)

OTHER PUBLICATIONS

Singer Futura CE-100 Embroidery Sewing Machine, Elizabeth Sewing Machine Outlet, http://www.singernj.com/singer_ce100.html, 3 pages, circa 2002.

(Continued)

*Primary Examiner*—Ismael Izaguirre
(74) *Attorney, Agent, or Firm*—Workman Nydegger

(57) ABSTRACT

The present invention relates to thread storage and dispensing systems which protect the thread from damage. A spool system of the present invention includes a thread spool around which thread is wound. A spool cap is mounted to the thread spool in a manner which substantially encloses the thread. The spool cap may include an opening through which the thread is extended as it is fed into a sewing machine. The spool cap may be selectively and removably mounted to the thread spool in any of a variety of manners. For instance, detents may be provided on the cap to engage a corresponding groove in the thread spool. Optionally, a stopper is provided which may be inserted into the opening through which the thread is fed into a sewing machine. The stopper may frictionally engage the cap and thread, and secure the thread to prevent it from unraveling.

25 Claims, 5 Drawing Sheets

U.S. PATENT DOCUMENTS

| | | | | | |
|---|---|---|---|---|---|
| 3,009,611 | A | | 11/1961 | Bates | |
| 3,213,815 | A | | 10/1965 | Rüssman | |
| 3,218,003 | A | * | 11/1965 | Bradshaw | 242/129.8 |
| 3,302,903 | A | * | 2/1967 | Vogel | 242/137.1 |
| 3,502,281 | A | | 3/1970 | Hardy-Thé McLain | |
| 3,672,598 | A | | 6/1972 | Saveth | |
| 3,698,546 | A | | 10/1972 | Kass | |
| 3,747,870 | A | | 7/1973 | Bonis et al. | |
| 3,879,002 | A | | 4/1975 | McClain et al. | |
| 3,990,375 | A | | 11/1976 | Adams | |
| 3,998,349 | A | | 12/1976 | Megowen | |
| 4,036,418 | A | * | 7/1977 | Chlebda | 206/391 |
| 4,050,648 | A | | 9/1977 | Tisma | |
| 4,141,519 | A | | 2/1979 | Tarrson et al. | |
| 4,669,681 | A | * | 6/1987 | Hansen et al. | 242/137.1 |
| 4,776,293 | A | * | 10/1988 | Yoshida | 112/302 |
| 5,280,741 | A | | 1/1994 | Bell et al. | |
| 5,607,050 | A | * | 3/1997 | Dolan et al. | 206/63.5 |
| 5,983,617 | A | * | 11/1999 | Nelson et al. | 57/3 |
| 6,467,419 | B2 | * | 10/2002 | Hori | 112/302 |
| 6,729,252 | B2 | * | 5/2004 | Wada et al. | 112/278 |
| 7,000,868 | B1 | * | 2/2006 | Moore et al. | 242/588.2 |
| 7,111,568 | B1 | | 9/2006 | Sakuma et al. | |
| 7,114,455 | B2 | | 10/2006 | Prüfer et al. | |

FOREIGN PATENT DOCUMENTS

| | | |
|---|---|---|
| JP | 8071278 | 3/1996 |
| JP | 8098977 | 4/1996 |

OTHER PUBLICATIONS

Nylon Monofilament Thread, http://www.cns-ind.com.hk.nylon.html, 1 page, circa Jan. 2007.

* cited by examiner

THREAD SPOOL AND CAP

CROSS-REFERENCE TO RELATED APPLICATIONS

This application claims the benefit of U.S. Provisional Patent Application No. 60/717,104, filed Sep. 14, 2005, and entitled THREAD SPOOL CAP SYSTEM, which is incorporated herein by reference in its entirety.

BACKGROUND OF THE INVENTION

1. The Field of the Invention

Exemplary embodiments of the invention relate to the field of sewing and embroidery. More particularly, the invention relates to apparatus and assemblies for protecting thread when in storage or use.

2. The Relevant Technology

Sewing, in one form or another, has been around for centuries. By some estimates, hand sewing has been around as an art form for more than twenty thousand years, when bones or animal horns were fashioned into needles, and animal sinew was made into thread. As time marched on, the equipment used for sewing became increasingly advanced and by the early 1800's, various sewing and embroidery machines were already being designed and manufactured. Since then, technology in the field has increased such that computer aided equipment is now the norm in both commercial and home settings, and even the hobbyist can design and produce complex patterns and designs with the assistance of computer technology.

Even with the advances in equipment, some of the same problems that have been around for centuries continue to trouble both the commercial sewer and the hobbyist. Many of these problems are found with the thread itself, or the systems for managing different threads. For example, thread is most commonly available on spools in which yards of thread are tightly wound for compact storage. As the thread is stored or used, however, it may unravel, causing the thread to become tangled. The likelihood that the thread will unravel or get tangled also increases as it is handled. In particular, as the thread is moved around, a person may grab onto the wound thread. Unless the person handles the thread with care, the person may push or pull against the strands of thread, thereby causing the thread to loosen or unravel, and increasing the chance that the thread will become entangled.

When thread becomes tangled, a sewer may have to cut the thread to remove the tangled portion before being able to use the thread. If the thread becomes tangled during a sewing operation, then it may bind, thereby causing the thread to break and requiring the sewer to stop sewing, discover and correct the problem, and reinsert the thread before sewing can continue. These difficulties are somewhat exacerbated in many modern systems in which various spools of thread are in close proximity, either in storage or when in use. For example, as thread unravels or is pulled off the spool and fed to a machine, the thread may tangle with nearby threads or spools, or may even catch on its own spool.

Various solutions have been previously proposed to deal with the problem of thread which unravels and/or becomes tangled, with varying degrees of success. For instance, when a spool of thread is stored, an adhesive (e.g., tape) may be stuck to a loose end of the thread and secured either to the spool itself or the wound thread. However, while this method is somewhat effective for storage of the thread, it does not alleviate the problems where multiple spools are used in close proximity. Moreover, the adhesive may bond to the thread, causing the thread to degrade or even causing the thread to tangle and bind when used.

Another solution has been to fit the thread into a groove or slit on the spool where it is frictionally secured in place. Again, however, this is mostly effective only during storage and transport of the thread. Moreover, the groove or slit can often hold the thread too tightly so that it is difficult to remove or becomes damaged, and may also create surfaces on which the thread may catch and bind when in use. A similar solution involves the use of separate plugs which snap onto the ends of a thread spool. As illustrated in FIG. 1A, for example, a plug snaps onto the base of a spool and can frictionally trap a loose end of the thread against the base of the spool. Similarly, and as illustrated in FIG. 1B, an end plug can snap into the top of a vertical thread support of a spool and frictionally trap the loose end of thread against the top end of the spool. However, while plugs are somewhat useful for preventing unraveling during transport and storage, they are often difficult to remove and do not provide any significant advantage while the thread is being used.

Various alternative solutions have been proposed to reduce tangling while thread is being used. For instance, machines may pull thread vertically off a spool to reduce the risk that it will catch on the spool. Alternatively, as shown in FIG. 1C, a tubular netting or webbing may be placed around the spool and press against the thread to keep one spool of thread from becoming entangled with another. However, where the netting remains in place while using the thread, the thread may catch and bind on the netting.

Additional difficulties are also encountered by sewing enthusiasts and professionals. For instance, threads are becoming increasingly more delicate so as to allow for increasingly decorative designs. The delicate threads may, however, degrade due to exposure to ultraviolet (UV) radiation, dust, or the oils in the human hand.

Accordingly, what is desired are apparatus, assemblies, and systems for improving thread management by reducing the risk that spools of thread will inadvertently tangle or unravel when in storage or during use. It is also desired to provide improved apparatus, assemblies and systems that protect against dust accumulation, exposure to oil, and UV radiation.

BRIEF SUMMARY OF THE INVENTION

Exemplary embodiments of the invention relate to apparatus, assemblies and systems for protecting thread from tangling, damage, and degradation. In particular, exemplary embodiments of the present invention include a spool and cap system in which a cap may remain on the spool during both storage and use. Use of the cap while in storage or use provides various desirable features including, for example, a reduction in the exposure of thread to dust and UV radiation, and/or a reduction in human handling of the thread.

In one embodiment, for example, a cap that may be mounted to a spool of thread is described. The cap includes a hollow shell portion that may be mounted to the spool. For instance, one end of the hollow shell may be mounted to the spool in a manner that allows the hollow shell to substantially encompass the thread spool. In addition, an opening may be formed in the hollow shell such that when the spool and any thread wound thereon is used in a sewing system, the thread from the spool is fed into the system through the opening. The opening may be formed at any location on the hollow shell including, for example, at a location opposite the first end of the hollow shell.

In some embodiments, the hollow shell is tubular. Accordingly, there may be a second opening located at the first end of the spool. In some embodiments, the second opening is larger than the first opening through which thread is fed. This first opening may also have a lip formed therearound. Optionally, the cap includes means or a structure for securing the hollow shell to the spool. For instance, in one embodiment the hollow shell has detents thereon which can be received by a corresponding structure on a thread spool.

A thread spool for use with a spool cap in a sewing system is also described. In one embodiment, the spool includes a base, a thread support structure joined to and extending from the base, and a retention structure on the base which can receive a top-mountable spool cap that substantially encompasses the thread support. The retention structure may include one or more grooves that receive a spool cap and/or corresponding detents on the spool cap so as to selectively mount the spool cap to the base. Thread may be wound around the thread support and the thread support may include a substantially tubular column which has a channel therein to receive a corresponding post of a sewing machine or system.

A spool assembly is also described which includes a thread spool and a spool cap mounted to the thread spool. The spool cap includes an opening through which thread from the spool may be fed into a sewing system. The spool assembly may include attachment means allowing the spool cap to be selectively mounted to the thread spool. In one embodiment, for example, the thread spool includes a base and the attachment means includes at least one groove in the base and one or more corresponding detents in the spool cap.

Optionally, the assembly includes a stopper that can be removably mounted to the opening of the spool cap. The stopper may frictionally engage the cap and thread received through the opening to, for example, prevent the thread from unwinding or tangling with thread from other spools. The stopper may include one or more taps to allow for easy removal of the stopper from the spool cap.

In the spool assembly, the thread spool may also be rotatable such that it can freely rotate with respect to the thread cap, or it may be fixed such that the cap rotates with the spool. The spool cap may also substantially encompass the thread spool and can be offset from the portion of the thread that is wound on the spool. In the spool cap, the opening through which thread is fed may be substantially parallel to the base, or a portion thereof, and the base itself may be wider than the spool cap.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope, nor are the drawings necessarily drawn to scale. The invention will be described and explained with additional specificity and detail through the use of the accompanying drawings in which.

DETAILED DESCRIPTION OF THE PREFERRED EMBODIMENTS

Exemplary embodiments of the invention relate to apparatus, assemblies and systems for protecting thread usable for any type of sewing. In particular, exemplary embodiments of the present invention relate to providing a cap which is mountable to a thread spool and remains in place during use and storage of the thread spool, and which may reduce dust accumulation on the thread, reduce the thread's exposure to UV radiation, and/or reduce damage resulting from human handling of the thread.

Reference will now be made to the drawings to describe various aspects of exemplary embodiments of the invention. It is understood that the drawings are diagrammatic and schematic representations of such exemplary embodiments, and are not limiting of the present invention, nor are they necessarily drawn to scale. No inference should therefore be drawn from the drawings as to the dimensions of any invention or element. In the following description, numerous specific details are set forth in order to provide a thorough understanding of the present invention. It will be obvious, however, to one of ordinary skill in the art that the present invention may be practiced without these specific details. In other instances, well-known aspects of methods and devices for winding thread on a spool have not been described in particular detail in order to avoid unnecessarily obscuring the present invention.

As used herein, the term "sewing" is broadly defined to refer to any process or action in which thread, yarn, string, or other similar materials are stitched or interlaced with fabric or are interwoven with itself. Accordingly, any process traditionally considered "sewing," as well as embroidery, serging (i.e., overcasting raw edges of fabric to prevent unraveling), knitting, crocheting, and the like are all properly considered "sewing," whether performed by hand or aided by a mechanical, electronic, or computerized device.

Figure 1A:
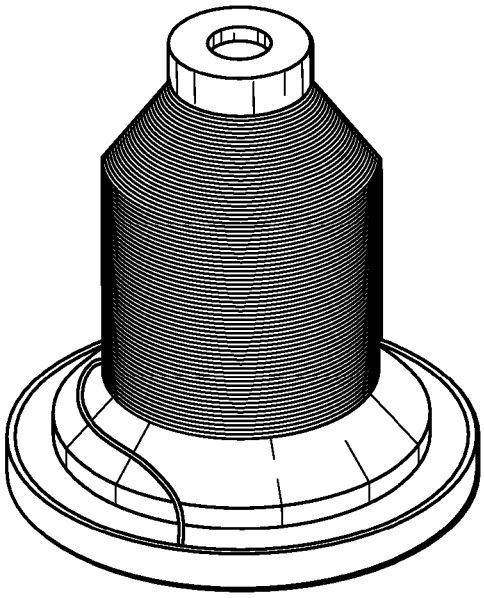
Fig. 1A (Prior Art)
FIG. 1A illustrates a prior art thread spool with a snap-in base for securing a loose end of thread.
Figure 1B:
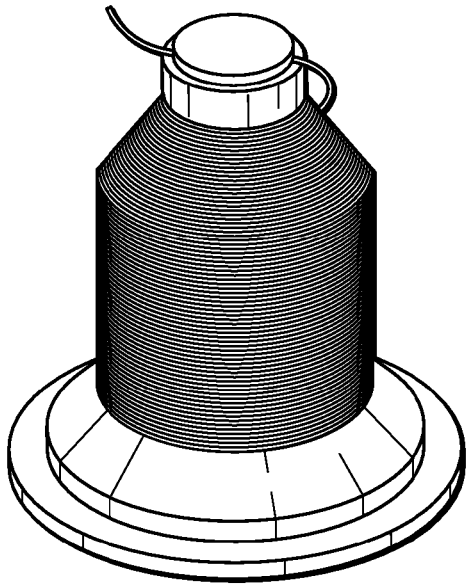
Fig. 1B (Prior Art)
FIG. 1B illustrates a prior art thread spool with a snap-in cap for securing a loose end of thread in place.
Figure 1C:
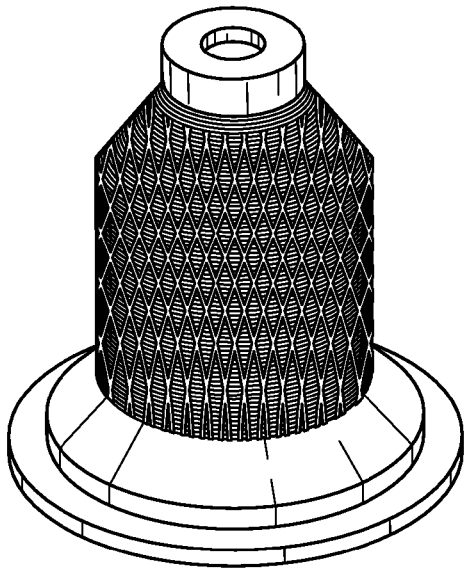
Fig. 1C (Prior Art)
FIG. 1C illustrates a prior art thread spool assembly in which webbing is wrapped around thread on a thread spool so as to prevent tangling of the thread with that of another spool.
Figure 2:
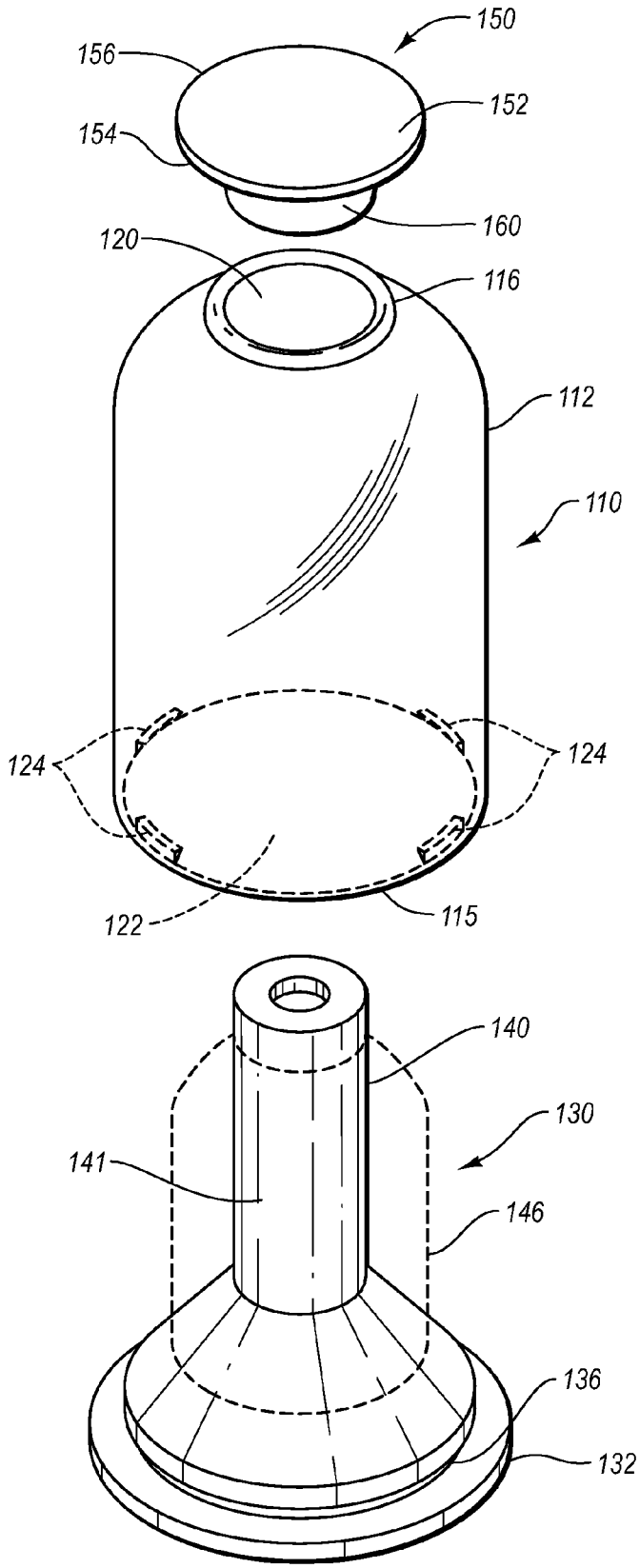
FIG. 2 is an exploded perspective view of a spool and cap assembly having a spool, an interlocking cap, and a stopper.

Referring now to FIG. 2, an exploded view of an exemplary spool and cap assembly 100 is illustrated according to one embodiment of the present invention. Spool and cap assembly 100 includes, in this embodiment, a spool 130, an interlocking cap 110 which may be mounted to spool 130, and a stopper 150 which may be mounted to cap 110. As described in greater detail herein, one feature of spool and cap assembly 100 is that thread 146 (illustrated in phantom lines as being wound on spool 130) can be secured in place and maintain tension so as to reduce the risk of unraveling and tangling. At the same time, thread 146 may be protected from degrading by reducing the risks of dust accumulation and exposure, UV radiation, and human handling.

In this embodiment, spool 130 includes a base 132 and a thread support 140 mounted to base 132 and around which thread 146 is wound. Thread support 140 may be of any suitable type and, in this embodiment, is a hollow, vertical column 141. It will be appreciated, however, that the illustrated embodiment is merely one configuration of a suitable spool and other designs are contemplated with a base on each end of a thread support, or a spool may have a thread support in different configurations or may have multiple thread supports.

Also illustrated in this embodiment is cap 110, which may be selectively mounted to spool 130 and may substantially encompass spool 130 and thread 146 wound thereon. As illustrated, cap 110 includes a hollow shell 1 12, a first opening 120 in hollow shell 112, and a second opening 122 in hollow shell 112. In the illustrated embodiment, first opening 120 and second opening 122 are illustrated, respectively, at the top and bottom of hollow shell 112. In light of the disclosure herein, however, it will be appreciated that first opening 120 need not be oriented at the top and second opening 122 need not be at the bottom of shell 122. For instance, spool and cap assembly 100 may be oriented in a horizontal direction (see e.g., FIG. 5), such that first and second openings 120 and 122 are on the left or right, respectively. Alternatively, or in addition thereto, while first opening 120 is here illustrated as being at a top end of hollow shell 112, and opposite second opening 122 at a bottom end of hollow shell 112, this is exemplary only. For instance, the first opening may be on a side of hollow shell 112 and/or substantially perpendicular to second opening 122.

In this embodiment, second opening 122 is configured to allow cap 110 to be placed around, and substantially encompass spool 130 when cap 110 is mounted to spool 130. For instance, hollow shell 112 can be inserted over spool 130 such that second opening 122 receives at least a portion of spool 130. In this embodiment, thread support 140 and at least of portion of base 132 are received within second opening 122, while a bottom surface 115 of hollow shell 112 abuts base 132 of spool 130.

As is further illustrated, and according to one aspect of the present invention, a groove 136 may be formed in base 132 of spool 130. Groove 136 may be configured to allow a person using spool and cap assembly 100 to selectively interlock cap 110 to spool 130. For instance, cap 110 includes, in this embodiment, four detents 124 proximate second opening 122, and which form ridges on the internal surface of hollow shell 112. Detents 112 may be positioned in such a way, and have a size and shape, that corresponds to the location, size, and depth of groove 136 on spool 130. In this manner, as cap 110 is placed on base 132 of spool 130, detents 124 may be positioned within groove 136 and thereby selectively and removably mount cap 110 to spool 130, and at least temporarily lock it in place. Accordingly, groove 136 and detents 124 are, both individually as well as collectively, examples of attachment means for securing cap 110 to spool 130.

Although four detents 124 and a single groove 136 are illustrated, it will be appreciated that this is exemplary only. In particular, any number of detents 124 may be used, and a single detent may be used which forms a single ridge around all or only a portion of hollow shell 112. Similarly, one or more grooves 136 may be formed. In this embodiment, single groove 136 is formed in spool 130 and detents 124 can move within groove 136 to allow cap 110 to be removably mounted to spool 130 while also freely spinning with respect to spool 130 when mounted. In alternative embodiments, however, multiple grooves may be formed which correspond to multiple detents or ridges on cap 110, which may lock cap 110 into a single position such that it cannot freely rotate with respect to spool 130.

As further illustrated, spool and cap assembly 100 may optionally include stopper 150 which may act as a plug of first opening 120. Stopper 150 is configured to be mounted to cap 110. In particular, in this embodiment, stopper 150 includes a top portion 152 which has a diameter greater than the diameter of first opening 120 in shell 112 of cap 110, and a mounting portion 160 which has a about equal to, or slightly larger than the diameter of first opening 120. In particular, in this embodiment, mounting portion 160 has a diameter that tapers from a diameter about equal to or slightly larger than the diameter of first opening 120 to a diameter less than the diameter of first opening 120. Accordingly, mounting portion 160 is approximately cork shaped such that the surface of mounting portion 160 easily fits within first opening 120, while the portion of mounting portion 160 adjacent top portion 152 must be compressed to fit securely within first opening 120.

Accordingly, stopper 150 may be formed of a flexible material such as, by way of representation and not limitation, rubber (natural or synthetic), silicone, or a silicone-based material. Mounting portion 160 of stopper 150 may thus be inserted into first opening 120 of cap 110 and compressibly secured therein by pressing on the top surface 153 of top portion 152. Mounting portion 160 can thusly be compressed within first opening 120 and frictionally secured in place such that a bottom surface 154 of top portion 152 abuts an upper surface 116 of shell 112 which surrounds first opening 120.

Figure 3A:
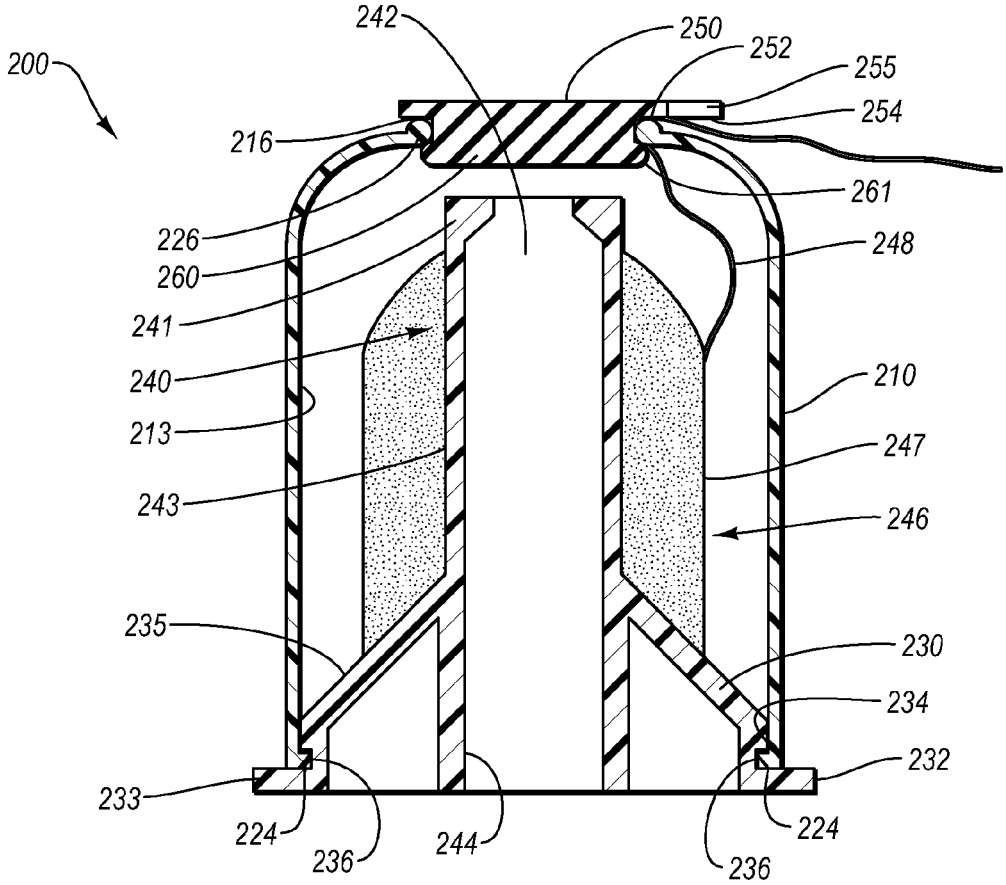
FIG. 3A is a cross-sectional view of an alternative embodiment of a spool and cap assembly.
Figure 3B:
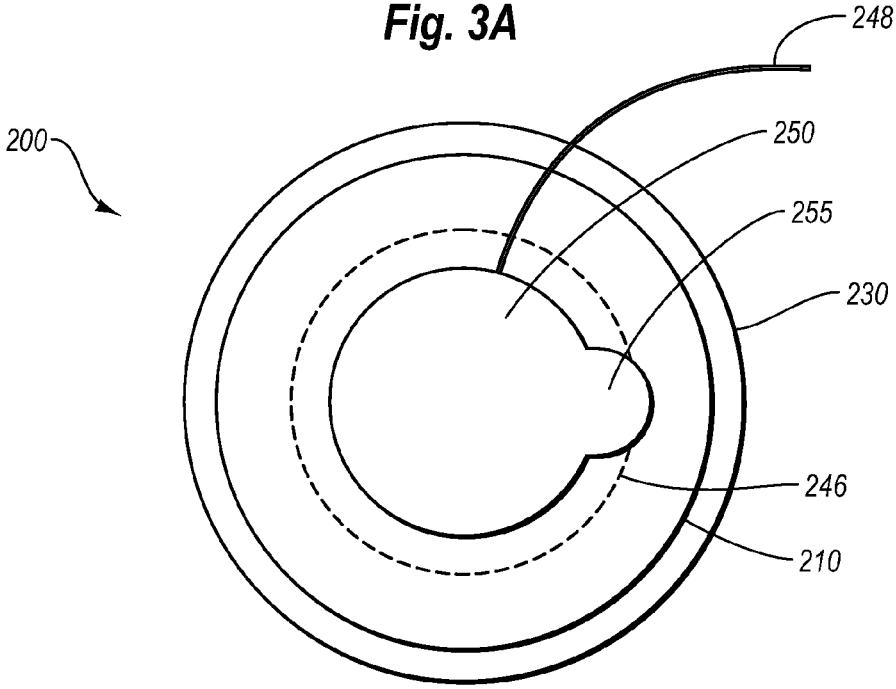
FIG. 3B is a top view of the spool and cap assembly of FIG. 2A.

An alternative embodiment of a spool and cap assembly 200 is illustrated in FIGS. 3A and 3B in which a cap 210 is mounted on a spool 230, while a stopper 250 is secured to cap 210 to prevent thread 246 from unwinding. In particular, FIG. 3A illustrates a cross sectional view of spool and cap assembly 200, while FIG. 3B illustrates a top view of assembly 200.

As illustrated, cap 210 may include a hollow shell 212 configured to be placed around, and substantially encompass thread 246 and spool 230. In particular, in the illustrated embodiment, hollow shell 212 fully encompasses a wound portion 247 of thread 246, a thread support 240 on spool 230, and a substantial portion of a base 232 on spool 230. Fully encompassing wound portion 247 of thread 246 provides a variety of desirable features. For instance, the risk that thread 246 will degrade can be reduced. In particular, thread 246 may degrade for a variety of reasons (e.g., dust collection, UV radiation, and human handling). By securing cap 210 to spool 230, such causes of degradation can largely be avoided. By way of example, cap 210 may be molded from a substantially impermeable material (e.g., polyethylene, polycarbonate, or polyacrylic). Dust or other particles in the air that could otherwise come into contact with thread 246 when it is exposed to the ambient environment, can instead be blocked by cap 210 and prevented from contacting thread 246.

Hollow shell 212 of cap 210 can further be configured to reduce the amount of dust to which thread 246 is exposed. For instance, in the illustrated embodiment, hollow shell 212 is substantially cylindrical with a slight narrowing taper near the upper opening. This slight taper contours to approximately match the contour of wound portion 247 of thread 246. In addition, tapered hollow shell 212 allows the size of the upper opening to be reduced with respect to the diameter of hollow shell 212 and base 232 of spool 230. By reducing the size of the upper opening, the area through which dust or air particles may enter and contact thread 246 is reduced, thereby also reducing the risk of thread degradation.

As should be appreciated in light of the discussion herein, the shape and configuration of hollow shell 212 can vary, and no particular configuration is limiting of the present invention. For instance, in the illustrated embodiment, hollow shell 212 is merely one example of a hollow shell that is usable in accordance with the principles of the present invention. For instance, while hollow shell 212 is substantially cylindrical and tapered, these features are not limiting and it need not be substantially cylindrical and/or tapered. For instance, a diameter or width of the hollow shell may vary along the length of the shell. By way of example, a hollow shell may be contoured to provide an ergonomic grip for a user.

By providing an additional layer around thread 246, cap 210 may also reduce the amount of UV radiation to which thread 246 is exposed. In one embodiment, for example, cap 210 may be formed from slightly opaque or tinted material that blocks a significant amount of the UV radiation. Tinted material may, however, make it difficult for a user to quickly view the thread and determine the color or style of the thread on spool 230. Accordingly, a label may be placed on cap 210 which identifies the thread by its color, style, manufacturer, and the like. Alternatively, cap 210 may be made of a substantially transparent material so as to allow a user to view through cap 210 and easily determine the color and style of thread. In such an embodiment, even where cap 210 is substantially transparent, it may provide at least some protection against UV radiation.

The use of cap 210 with spool 230 may further reduce damage to thread 246 that occurs by human handling and environmental exposure. Human handling of thread 246 can damage it in a variety of ways. For instance, the oils in a human hand can cause thread 246 to degrade. In addition, if a user grasps the wound portion 247 of thread 247, the user may pull against wound thread 247, thereby causing it to loosen and potentially tangle when it is used. Additionally, exposure to dirt and machine oil from sewing machines can also significantly degrade the thread during the sewing process. Cap 210 can reduce such risks by allowing a user to handle and manipulate thread spool 230 while decreasing the risk that the user will actually touch thread 246. In particular, when a user desires to store or transport thread 246, the user may mount cap 210 to spool 230. This can be done without ever touching wound portion 247 of thread 246. Moreover, as the thread is moved or relocated, the user may hold onto spool 230 or cap 210, while cap 210 covers thread 246, such that thread 246 is not touched by the user or such that, at most, a user contacts only loose end 248. Moreover, when the user wishes to use thread 246, the user may simply pull loose end 248 of thread 246 through the first opening and start sewing by hand or with a machine.

Handling of spool and cap assembly 200 without contacting thread 246 is further facilitated where cap 210 interlocks with spool 230 such that it can be selectively and/or at least temporarily mounted therewith. In the illustrated embodiment, and by way of example only, cap 210 can include one or more detents 224 on interior surface 213 of hollow shell 212, near the lower opening in shell 212, which mate with one or more corresponding grooves 236 on spool 230. In this manner, as cap 210 is placed over spool 230, the portion of cap 210 most proximate detents 224 can flex slightly to allow detents 224 to pass around spool 230, if necessary. Thereafter, as detents 224 match up with one or more grooves 236 in spool 230, detents 224 can cause cap 210 to snap or lock into place, thereby selectively securing cap 210 to spool 230 and facilitating handling thereof.

In some embodiments, spool 230 may include a base 232, a thread support 240 mounted to base 232, and thread 246 wound around at least a portion of thread support 240. In the illustrated embodiment, for example, spool 230 includes a base 232 that includes a multiple, interconnected portions. For instance, as illustrated, base may include a lower portion 233 against which a bottom surface of cap 210 may rest when cap 210 is mounted to, and interlocked with, spool 230. In this embodiment, lower portion 233 is substantially horizontal. A substantially horizontal lower portion 233 is desirable for a variety of reasons. For instance, as illustrated, lower horizontal portion 233 can be placed on a horizontal surface such as a table or thread cabinet and provide spool 230 with sufficient stability to remain in such a position. In addition, the diameter of lower horizontal portion 233 of base 232 may be greater than the diameter of hollow shell 212 adjacent the lower opening in hollow shell 212. It should be appreciated, however, that this feature is not necessarily limiting and that the diameter of lower horizontal portion 233 may be about equal to or less than the diameter of a corresponding portion of hollow shell 212. In fact, in some embodiments, lower horizontal portion 233 may be entirely eliminated.

Base 232 may also include an intermediate portion 234 directly or indirectly connected to lower horizontal portion 233. Intermediate portion 234 may be, in some embodiments, perpendicular or substantially perpendicular to lower horizontal portion 233. As illustrated, one or more grooves 236 may also be formed in vertical intermediate portion 234. Groove 236 can be configured to receive a corresponding ridge or detent 224 on interior surface 213 of cap 210, which facilitates mounting of cap 210 to spool 230 by interlocking the components. Accordingly, one or more grooves 236 and/or one or more detents 224 are properly considered attachment means for securing cap 210 to spool 230. It should also be appreciated, however, that detents 224 and groove 236 are merely one exemplary embodiment of attachment means for securing cap 210 to spool 230. For instance, in alternative embodiments, a groove may be formed on an upper surface of lower horizontal portion 233 of base 232. Thereafter, as cap 210 is placed on base 232, the bottom surface of shell 212 may be frictionally secured within such a groove. Alternatively, base 232 may include one or more detents, while one or more corresponding grooves can be formed in hollow shell 212. In still other embodiments, one or more a locking tabs may be mounted to a shell and slid within corresponding slots in a base, a latch may secured to a base and a corresponding loop affixed to the shell to receive the latch and interlock the cap with the spool, or the shell or base of the spool may be threaded to facilitate attachment. Indeed, any mechanical fastener or other structure, whether temporary or permanent, is properly considered attachment means.

Base 232 may also include an additional, upper portion 235 which connects base 232 to thread support 240. In this embodiment, upper portion 235 is inclined, although this feature is not necessarily limiting of the present invention. In particular, in the illustrated embodiment, inclined upper portion 235 of base 232 connects lower portion 233 and intermediate portion 234, so as to allow base 232 to provide support to thread support 240. Thread support 240 is configured to receive a wound portion 247 of thread 246 and allow spool 230 to dispense thread 246 as required by a user. To allow thread 246 to be wound thereon, thread support 240 may include a vertical column 241. Vertical column 241 directly supports thread 246 as wound portion 247 of thread 246 is directly wrapped around an exterior surface 243 of vertical column 241.

In addition, vertical column 241 may have a channel 242 extending through all or a portion of vertical column 241. Channel 242 is desirable for a number of reasons. For instance, a user of assembly 200 may use thread 246 in a sewing system that includes a motorized or other type of sewing machine. A sewing machine may include a support post configured to support a spool of thread used by the machine and allow the spool of thread to spin as thread is drawn therefrom. Accordingly, where spool 230 includes a channel 242, spool 230 can receive the support post of the sewing machine and be supported thereon.

In light of the discussion herein, it should be appreciated that thread support 240 may extend only outward from base 232 or it may extend through base 232. For instance, as illustrated in FIG. 3A, thread support 240 and channel 242 extends through base 232. One feature of extending thread support 240 in this manner is that a support post of a sewing machine can be placed within channel 242 and engage interior surface 244 of thread support, while the added length of thread support 240 improves the stability of spool 230 on the support post.

In some embodiments, stopper 250 is mounted to hollow shell 212 of cap 210. Optionally, loose end 248 of thread 246 may be extended through an opening in hollow shell 212 and trapped between stopper 250 and cap 210, and thereby secured in place. By trapping loose end 248 in this manner, tension is maintained between loose end 248 and wound portion 247 of thread 246, thereby reducing the risk that thread 246 will unravel and become tangled when stopper 250 is later removed and thread 246 is used. It will be appreciated, however, that stopper 250 is merely optional. For example, loose end 248 may be extended through a lower opening in cap 210 and frictionally secured and trapped between spool 230 and cap 210 when cap 210 is mounted to spool 230.

In this embodiment, stopper 250 includes a top portion 252 against which pressure is applied to mount stopper 250 in an opening of cap 210, and a mounting portion 260 which is inserted into the opening of cap 210. In this embodiment, mounting portion 260 includes a lip 261 opposite top portion 252, which has a diameter greater than the diameter of the corresponding opening in cap 210. Stopper 250 may be flexible such that lip 261 bends or compresses as mounting portion 260 is inserted into the opening in cap 210. Mounting portion 260 may also have a length greater than the thickness of shell 212, such that as lip 261 reaches the interior of shell 212, it may expand, thereby blocking the opening in shell 212 and securing stopper 250 to cap 210. In this manner, stopper 250 acts as a plug for the opening in cap 210.

In some embodiments, stopper 250 may be configured to allow a user to quickly and easily remove stopper 250 from cap 210. For instance, the diameter of top portion 252 may be substantially larger than the diameter of the corresponding opening in shell 212 or than lip 226, such that a user can easily pull against the fringes of top portion 252 to remove stopper 250. Alternatively, or in addition thereto, and as illustrated in FIGS. 3A and 3B, top portion 252 of stopper 250 may include a tab 255. Tab 255 is configured to allow a user to easily grasp stopper 250. In this manner, a user may more easily remove stopper 250 by easily gripping or otherwise handling tab 255 to pull stopper 250 off cap 210.

In some embodiments, spool and cap assembly 200 is configured to allow quick and easy removal of stopper 250 by including a lip 226 surrounding the rim of an opening in cap 210. In the illustrated embodiment, for example, lip 226 surrounds an upper opening through which loose end 248 of thread 247 is fed to a user or a sewing machine, and in which stopper 250 may be positioned. By including lip 226 around the opening, top portion 252 of stopper 250 is elevated from shell 212 and a user may easily slip a finger under top portion 252 to grasp it and pull to remove it from cap 210.

A feature of stopper 250 in spool and cap assembly 200 is that the exposure of thread 246 to dust can further be reduced. In particular, as stopper 250 is secured to cap 210, and cap 210 is secured to spool 230, wound portion 247 of thread 246 may be fully encompassed such that a substantially closed environment is created around wound portion 247. Consequently, cap 210 and stopper 250 prevent additional dust or other air particles from coming into contact with thread 246 while spool and cap assembly 200 is being stored or transported. However, this feature is optional as even if stopper 250 is removed, the exposure of thread 246 to dust and other particles is reduced. In particular, cap 210 blocks a substantial amount of dust and other particles is prevented from contacting thread 246, and only such particles that enter through the first, top opening could come into contact with thread 246.

Figure 4:
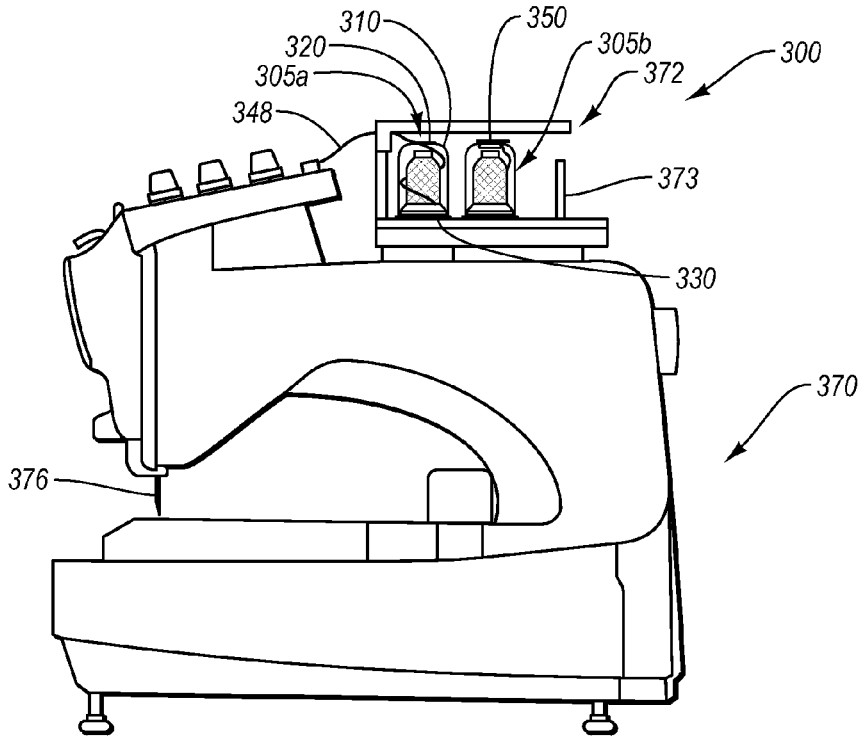
FIG. 4 is a frontal view of an exemplary environment in which a spool and cap assembly may be used in an upright position, the thread being drawn from the assembly in a vertical direction for use with an embroidery machine.
Figure 5:
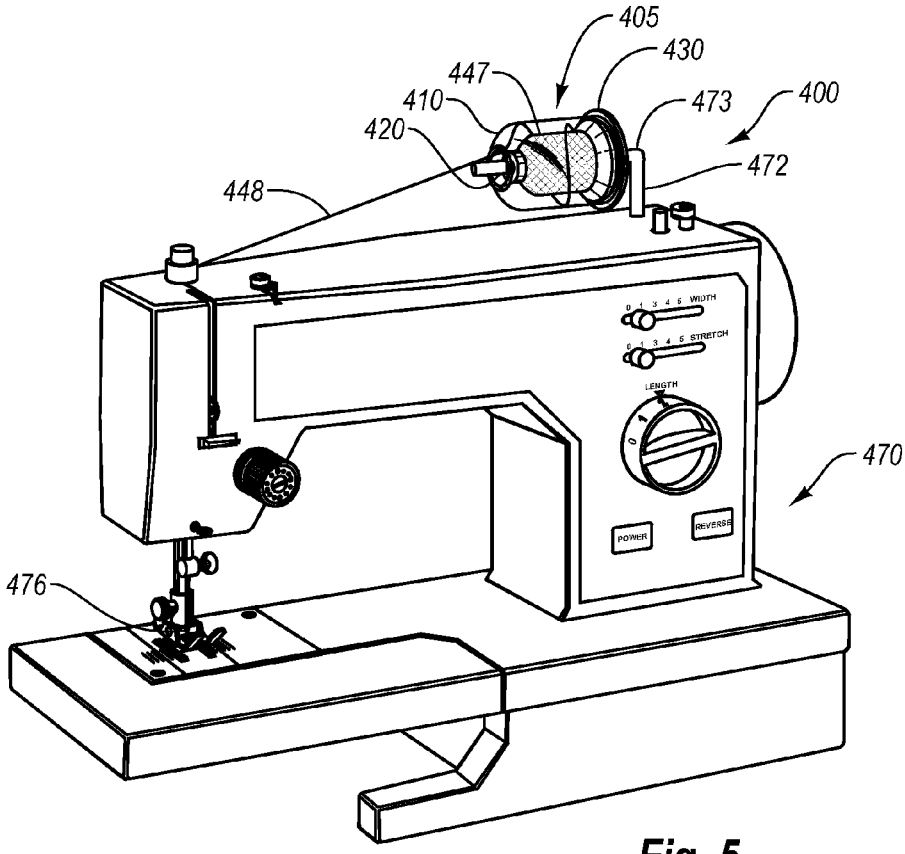
FIG. 5 illustrates an alternative environment in which a spool and cap assembly may be used, the thread being drawn in a horizontal direction for use with a sewing machine.

Illustrated in FIGS. 4 and 5 are exemplary environments in which a spool and cap assembly may be used, according to alternative embodiments of the present invention. It should be appreciated in light of the discussion herein that the illustrated environments are exemplary only and are not necessarily limiting. In particular, a variety of other types of sewing systems are contemplated for home and commercial use which are within the scope of the present invention.

In FIG. 4, an embroidery system 300 is illustrated in which one or more spool and cap assemblies 305*a*, 305*b* are mounted to or otherwise connected with an embroidery or other type of sewing machine 370 and thread is drawn vertically off the spool through a first opening 320 in a cap 310. In the illustrated embodiment, embroidery machine 370 includes a spool support 372 which is configured to hold up to three spools of thread at any time, although a spool support may designed to hold any number of spools. Spool support 372 includes three vertical support posts 373 which may be received within a channel of spool 330 so as to mount spool 330 to embroidery machine 370.

As illustrated, a first spool and cap assembly 305*a* is mounted to embroidery machine 370 adjacent a second spool and cap assembly 305*b*. Mounting spool and cap assemblies 305*a*, 305*b* to embroidery machine 370 in this manner allows a user to select and mount the thread necessary for a particular design and have the thread at hand even before the design is begun. As a result, when it is time to change thread, the next thread to be used is already mounted and need only be fed into embroidery machine 370 and down to needle 376.

In the illustrated embodiment, embroidery machine 370 is currently set-up to use thread from spool and cap assembly 305*a*, although it could just as easily be set-up with thread from spool and cap assembly 305*b*. In particular, a loose end 348 of thread from spool 330 is extended through a first opening 320 in cap 310 and fed into machine 370. As illustrated, the width of cap 310 does not vary with the width of the wound thread encompassed by cap 310, and is greater than the width of the wound thread encompassed by cap 310. Accordingly, the interior surface of cap 310 is always offset from the wound thread, although the extent of the offset may vary depending on the amount of thread on thread spool 330. Accordingly, as loose end 348 is drawn from thread wound around spool 330, it may spiral around the interior of cap 310 before it is drawn out of first opening 320 and fed into machine 370. In this manner, the offset between the interior surface of cap 310 and the wound thread limits the lateral distance of the spiraling of loose end 348.

One feature of limiting the spiraling of loose end 348 is that it reduces the risk that thread 348 will catch, bind, and break.

For example, if cap 310 were not mounted to spool 330, loose end 348 of the thread may have a spiral of a larger diameter and may, accordingly, spiral a greater distance from spool 330. As a result, as it is drawn from spool 330, it may spiral and reach or contact adjacent spool 305*b*, a post 373, or a part of machine 370. In so doing, loose end 348 of the thread may catch on another surface, edge, or tangle with other thread. However, where cap 310 limits the lateral movement of loose end 348 of the thread, its motion is more limited and less likely to catch on other spools or components.

In addition, cap 310 may be configured to reduce the risk that loose end 348 will catch and bind on cap 310. For instance, as illustrated, cap 310 remains mounted to spool 330 while thread 348 is drawn from spool 330 and fed into machine 370. Accordingly, cap 310 may be molded or otherwise formed from a solid material that has smooth surfaces. Consequently, the interior surface of cap 310 and the lip or surface around first opening 320 may also be smooth. In this manner, as loose end 348 spirals within cap 310 and is drawn through first opening 320, it moves over smooth surfaces and does not encounter any rough surfaces or edges on which loose end 348 of the thread may catch and bind.

As is further illustrated in FIG. 4, a second spool and cap assembly 305*b* may be mounted to embroidery machine 370. Second spool and cap assembly 305*b* may include a stopper 350 which secures a loose end of thread and/or which reduces the amount of dust that can enter into contact with thread fully or substantially enclosed within assembly 305*b*.

While sewing system 300 illustrates one embodiment in which thread may be drawn vertically through first opening 320 in spool assembly 305*a*, and fed into an embroidery machine, it should be appreciated that this feature is not necessary. For example, FIG. 5 illustrates an alternative embodiment of a sewing system 400 in which a spool and cap assembly 405 is mounted to a sewing machine 470 and a loose end 448 of thread is drawn horizontally from spool 430. In this embodiment, sewing machine 470 includes a spool support structure 472. Spool support structure 472 may further include, for instance, a horizontal post 473 which may extend fully or partially through a channel within spool 430, and which thereby mounds spool 430 to sewing machine 470.

As illustrated, spool 430 may have a cap 410 mounted thereto to form spool and cap assembly 405. Once spool and cap assembly 405 is mounted to spool support 470, loose end 448 of the thread may be drawn from wound portion 447 of the thread and extended through a first opening 420. It may be thereafter fed through sewing machine 470 so as to be used as needle 476 stitches with the thread.

While the foregoing embodiments in FIGS. 4 and 5 illustrate spool and cap assemblies which feed thread to a sewing machine in a vertical or horizontal direction, respectively, it should be appreciated that this is not necessarily limiting of the present invention. In particular, a spool and cap assembly according to the present invention is usable with any machine, regardless of the direction in which the thread is to be drawn. For instance, spool and cap assembly 305*a*, 305*b*, or 405 may also be oriented such that thread is drawn at an angle which is not horizontal or vertical, or may be oriented such that thread is drawn in a downward direction as shown, for example, in FIG. 6.

Figure 6:
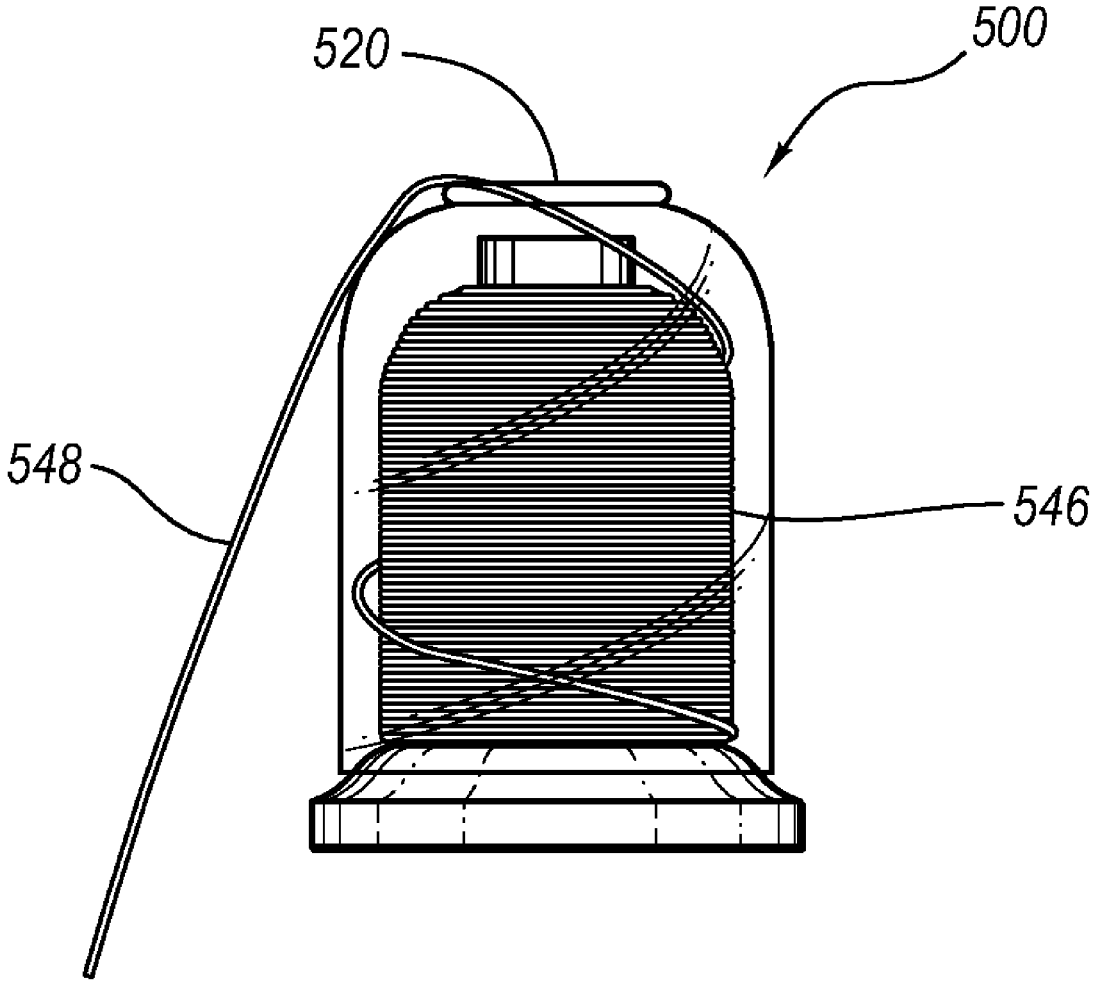
FIG. 6 illustrates an exemplary embodiment of a stand-alone spool and cap assembly according to one embodiment in which the thread is being drawn downward from the assembly.

In FIG. 6, a spool and cap assembly 500 is illustrated which may be used with any of a variety of sewing systems. Spool and cap assembly 500 is, in this embodiment, oriented vertically and a loose end 548 of thread 546 is drawn through a first opening 520 in assembly 500. Spool and cap assembly 500 may be positioned on a spool support for use with a sewing machine. The spool support may be integral with the sewing machine (e.g, located at spool support 372 in FIG. 4), or it may not be directly attached to the sewing machine (e.g, located at a nearby shelf or table) such that spool and cap assembly 500 is used as a stand-alone assembly.

In this embodiment, loose end 548 of thread 546 is drawn through opening 520 and downward as it is pulled from below assembly 550. This may be useful where, for example, a sewing machine draws the thread from spool and cap assembly 500 when it is located on an elevated shelf Accordingly, it should be appreciated that a spool and cap assembly of the present invention is self-orienting such that thread may be drawn off the assembly in any direction. As a result, it is also not necessary that the spool and cap assembly be mounted to a thread support of a machine when the thread is used. In particular, as noted above, the spool and cap assembly may merely be connected to the machine by feeding the loose end of the thread to the machine, while the spool and cap assembly is, for example, on a table, shelf, or the like. This may be particularly useful where, for example, the spool can rotate with respect to the cap as previously described herein.

In addition, while FIGS. 4 and 5 illustrate that an opening in a cap through which thread is fed is perpendicular to an elongate length of the cap, it should be appreciated that this feature is not necessarily limiting. In fact, because the spool and cap assembly of the present invention is self-orienting, the opening may be positioned anywhere in the cap. For instance, the cap may have one or more circular or elongate openings along a side of the cap, while a stopper may also be provided and/or used with a corresponding shape and size.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A thread spool and cap assembly, comprising:

a thread spool, wherein said thread spool includes:

a thread support configured to receive thread therearound, said thread support extending in a first direction and having opposing first and second ends; and a single base integrally formed with said thread support and extending from said first end of said thread support, said base including a substantially flat end surface said substantially flat end surface extending substantially perpendicularly to said thread support, and said base further including an intermediate surface disposed between said thread support and said substantially flat end surface, said intermediate surface extending substantially perpendicularly from said substantially flat end surface, and substantially parallel to said first direction, wherein said substantially flat end surface and said intermediate surface each have a width greater than a width of said thread support;

an integrally formed hollow shell selectively mounted to said thread spool, said integrally formed hollow shell including an exterior surface and an interior surface, said integrally formed hollow shell further including a substantially flat end surface at a first end of said hollow shell, and a width of said hollow shell at said interior surface being greater than said width of said thread base, and wherein said integrally formed hollow shell fully extends around said thread spool proximate said second end of said thread support; and a retention structure integrally formed on said interior surface of said hollow shell and proximate said substantially flat end surface, said retention structure being configured to selectively mount said integrally formed hollow shell to said thread spool such that said integral hollow shell substantially encloses said vertical thread support within a space defined by said interior surface of said integral hollow shell, and wherein said retention structure causes said substantially flat end surface of said hollow shell to rest upon said substantially flat end surface of said single base, and such that at least a portion of said substantially flat end surface extends from, and is not enclosed within, said integrally formed hollow shell.

2. A thread spool and cap assembly as recited in claim 1, wherein said integrally formed hollow shell further includes an opening hollow shell, said opening being configured for said thread to be fed therethrough when said hollow shell is mounted to said thread spool and said thread spool is used by a sewing system.

3. A thread spool and cap assembly as recited in claim 2, wherein said opening is at a second end of said hollow shell, said second end being on an opposite end of said hollow shell as compared to said first end of said hollow shell.

4. A thread spool and cap assembly as recited in claim 2, wherein said hollow shell is substantially tubular and has a second opening at said first end of said hollow shell, said second opening being defined by said interior surface of said hollow shell, and wherein said second opening permits said substantially flat end surface of said hollow shell to be seated on said substantially flat end surface of said single base, and wherein said second opening is larger than said first opening.

5. A thread spool and cap assembly as recited in claim 1, wherein said hollow shell includes a lip integrally formed in hollow shell and adjacent and at external to said opening.

6. A thread spool and cap assembly as recited in claim 1, wherein said intermediate surface of said single base of said thread support is an external surface of said thread spool and includes at least one groove formed therein, said at least one groove being configured to receive said retention structure therein to thereby releasably secure said hollow shell to said thread spool.

7. A thread spool and cap assembly as recited in claim 1, wherein said retention structure includes one or more detents integrally formed on said interior surface of said hollow shell, said one or more detents being adapted to form an interlocking fit selectively and releasably securing said hollow shell to said thread spool by engaging said intermediate surface of said base, said intermediate surface of said base being an external surface of said thread spool.

8. A thread spool and cap assembly as recited in claim 1, wherein said hollow shell is substantially cylindrical.

9. A thread spool and cap assembly as recited in claim 1, wherein said hollow shell is tapered at said second end of said hollow shell.

10. A thread spool for use in a sewing system, the thread spool comprising:

a thread support configured to have thread wound thereon;

a single base joined to and extending perpendicularly from said thread support, said base including a substantially flat external end surface and a substantially flat external intermediate surface, wherein said substantially flat external end surface and substantially flat external intermediate surface are substantially perpendicular to each other and said substantially flat intermediate surface is substantially parallel to said thread support; and a retention structure on said base for selectively receiving a spool cap which substantially encompasses said thread support and secures said spool cap to the thread spool at a single end thereof, said retention structure comprising one or more grooves formed in said substantially flat external intermediate surface, said one or more grooves being configured to receive a corresponding structure on an interior surface of said spool cap.

11. A thread spool as recited in claim 10, wherein said one or more grooves are configured to receive one or more corresponding detents of said spool cap.

12. A thread spool as recited in claim 10, wherein said thread support fully extends through said base of the thread spool.

13. A thread spool as recited in claim 10, wherein said thread support comprises a substantially tubular column on which thread may be wound, said substantially tubular column having a channel therein for receiving a corresponding post of a sewing system.

14. A thread spool as recited in claim 10, further comprising thread wound around said thread support.

15. A spool system for delivering thread, the spool system comprising:

a thread spool, said thread spool having a thread support and a base extending outwardly from said thread support, wherein only a single base extends from said thread support; and an integrally formed spool cap selectively mounted to said thread spool, said spool cap comprising one or more retention structures on an interior surface of said spool cap and proximate a first end of said spool cap, and said spool cap having an opening through which thread from said thread spool is fed when used by a sewing machine, wherein said retention structures releasably and selectively secure said spool cap to said thread spool such that said spool cap is mounted to said base of said thread spool at only a single end of said thread spool, and such that at least a portion of said single base remains exposed and is not enclosed within said spool cap, and wherein said retention structures on said interior surface of said spool cap engage an intermediate surface of said base that is external on said thread spool and outward relative to said thread support.

16. A spool system as recited in claim 15, wherein said intermediate surface of said base includes one or more external grooves formed so as to extend around and parallel to said thread support.

17. A spool system as recited in claim 15, wherein said one or more retention structures on said interior surface of said spool cap include one or more detents adapted to create an interlocking fit with said single base of said thread spool when said one or more detents are positioned against said intermediate surface of said single base.

18. A spool system as recited in claim 15, further comprising a stopper removably mounted to said opening of said spool cap, said stopper being adapted to frictionally engage thread received through said opening against an external surface of said stopper and a surface of said spool cap defining said opening.

19. A spool system as recited in claim 18, wherein said stopper comprises one or more tabs for facilitating removal of said stopper from said opening.

20. A spool system as recited in claim 15, wherein said thread spool is rotatable with respect to said spool cap when mounted thereto.

21. A spool system as recited in claim 15, wherein said thread spool is substantially prevented from rotation with respect to said spool cap when mounted thereto.

22. A spool system as recited in claim 15, wherein said opening is substantially parallel to at least a portion of said base.

23. A spool system as recited in claim 15, wherein said base of said spool is wider than any portion of said spool cap.

24. A spool system as recited in claim 15, further comprising a sewing machine, said sewing machine receiving said thread from said thread spool through said opening.

25. A system for enclosing and protecting thread, comprising:

(a) a thread spool, said thread spool including:

(i) a support configured to have thread wound around an exterior surface thereof and (ii) a base attached to said support, said base having a width greater than a width of said support, said base including an external surface that is substantially perpendicular to said support and that is positioned outward relative to said support;

(b) a cap that is selectively attachable to said thread spool, said cap including:

(i) a hollow shell having an interior surface and an exterior surface, said hollow shell being configured to fit around and substantially enclose said support and any thread wound thereon; and (ii) one or more ridges formed on said interior surface of said hollow shell, said one or more ridges on said interior surface of said hollow shell being configured to selectively secure said cap to said thread spool by engaging said external surface of said base, thereby substantially enclosing said external surface and said support within interior surface of said hollow shell.

* * * * *